US011085261B2

(12) United States Patent
Gardner

(10) Patent No.: US 11,085,261 B2
(45) Date of Patent: Aug. 10, 2021

(54) WELL LOGGING ASSEMBLY

(71) Applicant: ZIEBEL AS, Tananger (NO)

(72) Inventor: Neil Livingston Gardner, Central Scotland (GB)

(73) Assignee: Ziebel AS, Tananger (NO)

( * ) Notice: Subject to any disclaimer, the term of this patent is extended or adjusted under 35 U.S.C. 154(b) by 0 days.

(21) Appl. No.: 16/638,453

(22) PCT Filed: Aug. 17, 2018

(86) PCT No.: PCT/GB2018/052341

§ 371 (c)(1),
(2) Date: Feb. 11, 2020

(87) PCT Pub. No.: WO2019/034892

PCT Pub. Date: Feb. 21, 2019

(65) Prior Publication Data

US 2020/0217145 A1 Jul. 9, 2020

(30) Foreign Application Priority Data

Aug. 17, 2017 (GB) ..... 1713209

(51) Int. Cl.
*E21B 23/00* (2006.01)
*E21B 47/13* (2012.01)
(Continued)

(52) U.S. Cl.
CPC ..... *E21B 23/001* (2020.05); *E21B 17/003* (2013.01); *E21B 23/00* (2013.01);
(Continued)

(58) Field of Classification Search
CPC ..... E21B 17/003; E21B 47/13; E21B 23/00; E21B 47/00; E21B 23/001; E21B 23/14; E21B 47/125; H01B 7/046; D07B 1/147
See application file for complete search history.

(56) References Cited

U.S. PATENT DOCUMENTS 5,495,547 A 2/1996 Ratie et al.
5,495,755 A 3/1996 Moore
(Continued)

FOREIGN PATENT DOCUMENTS

EP 0 491 095 A1 6/1992
EP 1 251 242 A1 10/2002
(Continued)

OTHER PUBLICATIONS

Patents Act 1977: Search Report under Section 17(5) dated Oct. 2, 2017.

(Continued)

*Primary Examiner* — Brad Harcourt
(74) *Attorney, Agent, or Firm* — SmithAmundsen LLC

(57) ABSTRACT

A well logging assembly adapted to collect data from the well, comprises a downhole locomotive to move a downhole portion of the logging assembly into the well, a power conduit to supply power from the surface to the downhole portion and a data conduit to transmit data from the downhole portion to the surface. The power conduit comprises a single electrical conductor to send electrical current to the downhole portion from a power supply at the surface. The downhole portion comprises an electrical contact exposed to the well for transmission of the return path for the electrical current to the surface.

24 Claims, 6 Drawing Sheets

(51) Int. Cl.

| | |
|---|---|
| ***E21B 17/00*** | (2006.01) |
| ***E21B 47/00*** | (2012.01) |
| ***H01B 7/04*** | (2006.01) |
| ***E21B 23/14*** | (2006.01) |

(52) U.S. Cl.
CPC ..... *E21B 23/14* (2013.01); *E21B 47/00* (2013.01); *E21B 47/13* (2020.05); *H01B 7/046* (2013.01)

(56) References Cited

U.S. PATENT DOCUMENTS

| | | | | |
|---|---|---|---|---|
| 6,711,947 | B2 * | 3/2004 | Maute | E21B 47/017 73/152.29 |
| 6,857,486 | B2 | 2/2005 | Chitwood et al. | |
| 6,868,906 | B1 | 3/2005 | Vail, III et al. | |
| 7,769,260 | B2 | 8/2010 | Hansen et al. | |
| 9,246,405 | B2 | 1/2016 | Bank | |
| 2004/0112646 | A1 | 6/2004 | Vail et al. | |
| 2004/0124015 | A1 | 7/2004 | Vail et al. | |
| 2005/0051341 | A1 * | 3/2005 | Khazanovich | E21B 33/0385 166/379 |
| 2006/0044155 | A1 * | 3/2006 | Le Briere | E21B 47/13 340/854.3 |
| 2008/0264643 | A1 * | 10/2008 | Skeels | E21B 33/076 166/348 |
| 2010/0194588 | A1 * | 8/2010 | Menezes | G01V 1/22 340/854.9 |
| 2011/0234421 | A1 | 9/2011 | Smith | |
| 2012/0222869 | A1 | 9/2012 | Varkey | |
| 2015/0076901 | A1 | 3/2015 | Panguluri et al. | |
| 2015/0167416 | A1 * | 6/2015 | Ludwig | E21B 23/14 166/385 |
| 2015/0233200 | A1 | 8/2015 | Varkey | |
| 2015/0233220 | A1 | 8/2015 | Tiong et al. | |
| 2016/0069174 | A1 * | 3/2016 | Cannan | E21B 43/267 166/250.1 |
| 2017/0268304 | A1 | 9/2017 | Varkey | |
| 2017/0328198 | A1 * | 11/2017 | Van Der Ende | E21B 47/13 |
| 2019/0024481 | A1 * | 1/2019 | Shanfield | E21B 47/017 |
| 2019/0257194 | A1 * | 8/2019 | Garner | E21B 17/206 |

FOREIGN PATENT DOCUMENTS

| | | | |
|---|---|---|---|
| EP | 2 469 308 | A1 | 6/2012 |
| GB | 2 352 376 | A | 1/2001 |
| WO | 2009048459 | A1 | 4/2009 |

OTHER PUBLICATIONS

Notification of Transmittal of The International Search Report and The Written Opinion of The International Searching Authority, or The Declaration issued in International Application No. PCT/GB2018/052341 dated Oct. 25, 2018.

N. Gholson et al., "Electrical Characteristics of Sea-Water-Return Transmission Lines", Ocean Technology Division, Ocean Science and Technology Laboratory, Aug. 1982.

* cited by examiner

WELL LOGGING ASSEMBLY

CROSS-REFERENCE TO RELATED APPLICATIONS

The present application is a National Stage of PCT/GB2018/052341, filed Aug. 17, 2018, which claims priority under 35 U.S.C. 119(b) to GB 1713209.3, filed Aug. 17, 2017, all of which are incorporated by reference herein in their entirety.

The present invention relates to a well logging assembly for gathering information from a downhole oil or gas well, and to a method of logging an oil or gas well. The invention also relates to a downhole electrical cable suitable for use with the assembly.

BACKGROUND OF THE INVENTION

Oil and gas wells are frequently logged by passing a gauge or measuring device into the well to collect data relating to downhole conditions in the well (pressure, temperature, electrical resistivity, etc.) and to report data collected to the surface for analysis. The collected data is useful to maximise the production of useful hydrocarbons from the well, and limit the production of fluids from zones that are not especially productive, or in which the production fluids have undesirable qualities such as corrosive agents, water etc. Downhole locomotives are often deployed in an oil or gas well to deliver the logging assembly to the toe of the well, furthest from the surface.

U.S. Pat. No. 7,769,260, US2011/234421, EP2469308 and WO2009/048459 describe downhole items useful for understanding the invention.

SUMMARY OF THE INVENTION

The present invention provides a well logging assembly adapted to collect data from the well, comprising a downhole locomotive adapted to move a downhole portion of the logging assembly into the well, the assembly comprising a power conduit adapted to supply power from the surface to the downhole portion and a data conduit adapted to transmit data from the downhole portion to the surface, wherein the power conduit comprises a single electrical conductor adapted to send electrical current to the downhole portion from a power supply at the surface, and wherein the downhole portion comprises an electrical contact exposed to the well for transmission of the return path for the electrical current to the surface.

The electrical contact is optionally adapted to engage an inner surface of the well, optionally an electrically conductive portion of the well, although the return path can be routed instead through conductive fluids passing through the well without any physical contact between the electrical contact and the well. Optionally the well is cased with electrically conductive casing, and the return path for the current from the downhole portion to the surface passes through the casing.

Optionally the power supply is electrically connected to the well, for example, via a clamp connecting the power supply to the casing optionally at the surface. Optionally the return path for the current passes through the earth, optionally through ground formation layers which may be porous and liquid-filled. Optionally the return path for the current passes through a conductive fluid, such as brine, which can be collected in a pit at the surface, and connected to the power supply to complete the circuit, optionally via an electrode connecting the brine in the pit to the power supply. Optionally the return path for the current passes through fluids produced from the well.

Optionally the data conduit transmits data from the surface to the downhole portion, for example to actuate or control the downhole tool. Optionally the data conduit transmits data to and/or optionally from the locomotive, optionally to control the locomotive, and optionally to transmit data relating to the locomotive back to the surface. Optionally the data conduit comprises one or more, for example, 2, 3, 4 or more fibre optic lines. Optionally 2-10 fibre optic lines are provided. The fibre optic lines are selected to be suitable for use in harsh environments, such as an oil or gas well, optionally with a temperature rating of at least 250 degrees Celsius. Optionally the data conduit is housed in a tube, for example a metal tube, optionally steel such as stainless steel. Optionally a flat metal strip is rolled into a tube around the data conduit to encase the data conduit within the tube. Optionally the juxtaposed sides of the metal strip can be welded together to form a solid seam, optionally making the metal tube pressure tight. Optionally the fibre optic lines are suspended or embedded in a support matrix within the tube, optionally comprising a thixotropic gel. Optionally where the support matrix comprises a gel, the gel is injected into the tube around the fibre optic lines.

Optionally the resulting assembly of the tube and data conduit can be coiled onto a reel for application of additional layers when required.

Optionally data is transmitted via optical communication through the fibre optic lines. Optical communication offers the advantage of higher data transmission rates, as electrical telemetry data rates may be curtailed by the changing electrical impedance that may otherwise be suffered by e.g. the power conduit and return path when the locomotive is moving with the well.

Optionally the downhole portion can incorporate a sensing mechanism, which can be connected to the downhole end of the data conduit, and optionally to the downhole end of the power conduit. Optionally the sensing mechanism can sense downhole conditions and generate data on the same to transmit to the surface. Optionally the sensing mechanism can be incorporated into a separate logging tool. Optionally the sensing mechanism can be a characteristic of the data conduit, which can be adapted to collect data for transmission to the surface.

Optionally the power conduit comprises a braided copper conductor, comprising a plurality of individual wires braided into a single conductor, optionally providing a single phase electrical conductor, transmitting current from the power supply at the surface to the downhole portion in the well without carrying the return path of the current from the downhole portion to the surface. Optionally the power conduit supplies power to the logging tool. Optionally the power conduit supplies power to the locomotive. Optionally the power conduit is electrically isolated from the well by a layer of insulation on its outer surface.

Optionally the power conduit comprises a tubular structure, optionally surrounding the signal conduit. Optionally where the signal conduit is housed in a tube, the power conduit surrounds the tube. Optionally where the power conduit comprises a braided conductor (optionally formed from copper wire), the conductor may be wound directly onto the surface of the metal tube, without any electrical insulation between the tube and the conductor. Optionally the winding of the wire(s) onto the surface of the metal tube is carried out in a continuous process to form the conductive layer. Optionally there is a layer of electrically insulating material covering the outer surface of the metal tube, optionally comprising a fluoropolymer material. Including a layer of electrically insulating material advantageously reduces the risk of galvanic cells being formed by dissimilar materials in the metal tube and the braided wire.

Optionally the logging assembly comprises one or more insulation layers for electrically isolating any one of the components from other components. Optionally at least one insulation layer may comprise a fluoropolymer, e.g. PTFE. Optionally the insulation layers include one or more of insulation between the data conduit and the metal tube; between the metal tube and the power conduit; between the power conduit and the strength member.

Optionally, after the power conduit is arranged in its desired configuration relative to the data conduit and/or the tube, the unfinished cable may be run on a cable insulation extruder line to form a layer of electrically insulating material over the power conduit. Optionally the extruder line applies molten insulating material in a layer to cover the power conduit, for example, the extruder line may apply a layer of molten fluoropolymer over the braided copper conductor. Once the layer of insulation has been formed to its desired thickness, it is then optionally cooled by placing the optionally still unfinished cable into a cooling bath, e.g. of water. The insulating material can then be dried for testing in a spark tester to verify that there are no e.g. pin holes or voids in the insulating layer.

Optionally the thickness of the layer of insulation is predetermined and must meet a required working voltage of up to 1200 volts, in a temperature range of −30 to 177 degrees Celsius.

Optionally the logging assembly comprises a strength member adapted to resist axial strain on the power and data conduits. Optionally the strength member comprises an elongate member extending between the surface and the downhole portion and having a long axis. Optionally the strength member comprises a composite material such as fibre and resin, optionally carbon fibre. The resin can be curable by addition of a curing chemical agent or by a curing treatment (e.g. UV light). The strength member is optionally substantially resistant to axial extension. Optionally the fibres in the composite material are substantially unidirectional in a direction substantially parallel to the long axis of the elongate member. Optionally the strength member is applied over the outer surface of the power conduit. Optionally the strength member is electrically non-conductive, or is of low conductivity, so that it acts as an electrical insulator for the power conduit. Optionally the strength member is applied over the outer surface of the insulating layer, where insulating material has been applied over the power conduit.

Optionally the strength member offers protection for the inner core, which optionally comprises the power and/or data conduit(s). Optionally the strength member further provides mechanical support for any tools, including the locomotive, which may be attached to the cable at its downhole end. Optionally this enhances retraction of the tools and the cable out of the well from extreme depths, for example where conditions are unfavourable and tools may otherwise become stuck or jammed as a result of debris, blockages, or partial well bore collapses and the like.

Optionally the power conduit and data conduit are combined in a cable or rod, which optionally also comprises the strength member, and optionally layers of insulation. Optionally the outer surface of the cable or rod (optionally formed by the strength member) comprises a low friction material.

Optionally the strength member forms the outermost surface of the cable. Optionally the low friction material of the strength member offers a reduced coefficient of friction between the outermost surface of the cable and the inner diameter of the casing. The reduction in the coefficient of friction results in increased "pull" force being available at the downhole end of the cable in comparison to e.g. a traditional steel wireline.

Optionally the cable is adapted to connect to one or more of the locomotive and a logging tool. Optionally the return path for the current to the surface passes through the locomotive.

Optionally the locomotive incorporates at least one wheel or other conveyance mechanism such as a track, blade, ski, etc., which engages the inner surface of the well, and is optionally operated to drive the locomotive axially within the well. Optionally the return path for the electrical current passing from the downhole portion to the surface passes through the conveyance mechanism (e.g. at least one wheel, etc.). Optionally the locomotive can incorporate electrical contacts to earth the locomotive and to complete an electrical circuit between the power conduit, the well, and the power supply at the surface. The electrical contacts can optionally be disposed on the, or each, wheel or other conveyance mechanism(s). Optionally the conveyance mechanism can be resiliently biased radially outward from a body of the downhole portion, into contact with an inner surface of the well. Optionally the engagement between the conveyance mechanism and the casing provides electrical and/or optionally frictional contact. The conveyance mechanism can optionally comprise one or more gripping formations such ridges, teeth, etc. to increase grip between the conveyance mechanism and the well.

Optionally the, or each, wheel or other conveyance mechanism may be attached to at least one arm. Optionally the, or each, arm is retractable and extendable, and the wheel or other conveyance mechanism is attached to an end of the arm. Optionally the arm can be retracted into the body of the locomotive when the locomotive is being deployed downhole, and/or when the locomotive is being extracted from the well to the surface, to enhance the travel of the locomotive in either direction within the well. Optionally once the locomotive has reached its initial deployment location, a signal can optionally be sent to the locomotive instructing it to extend its arm or arms. Optionally, the arms are resiliently biased towards an extended configuration, and are optionally adapted to react to changes in the surface of the casing, e.g. debris, by passively moving towards and away from the body of the locomotive.

Optionally the locomotive can comprise a downhole tractor.

Optionally, by providing only a single electrical conductor (essentially a single wire) in the assembly and relying on a return path through the earth, the weight of the power and data conduits and the cable as a whole can be reduced. Optionally the single electrical conductor provides one leg of a direct current circuit which can be used to drive the locomotive. The reduction in weight of the cable permits a longer range for the locomotive, which can therefore reach the toe of deeper wells before friction and weight of the cable become too great for the power of the locomotive.

Optionally the electrical return path, optionally via the locomotive, further comprises a metal collar and spring centraliser arrangement. Optionally the centraliser is attached to the housing of the locomotive. Optionally the centraliser comprises sharp fins that are adapted to cut through surface deposits that may have accumulated on the inner diameter of the well casing. Optionally the action of the fins improves the contact between the locomotive and the casing, and thereby improves the return path by reducing the contact resistance.

The invention also provides a downhole electrical cable for downhole use in an oil or gas well, comprising a power conduit adapted to supply power, and a data conduit adapted to transmit data, wherein the power conduit comprises a single electrical conductor adapted to form one leg of an electrical circuit, and wherein the return path of the electrical circuit passes through an earth connection.

Optionally the single electrical conductor comprises a single phase conductor. Optionally the single electrical conductor consists of a single phase conductor, optionally transmitting current only in one direction, between the power supply and the downhole portion, without transmitting current in the return leg between the downhole portion and the power supply through the power conduit itself.

The present invention also provides a data transfer assembly adapted to transmit data to or from an oil or gas well, comprising a downhole locomotive adapted to move a downhole portion of the data transfer assembly into the well, the assembly comprising a power conduit adapted to supply power from the surface to the downhole portion and a data conduit adapted to transmit data between the downhole portion and the surface, wherein the power conduit comprises a single electrical conductor adapted to send electrical current to the downhole portion from a power supply at the surface, and wherein the downhole portion comprises an electrical contact exposed to the well for transmission of the return path for the electrical current to the surface.

The invention also provides a method of transferring data to or from an oil or gas well, comprising moving a downhole assembly into the well, the downhole assembly having a downhole locomotive, a power conduit adapted to supply power to the downhole assembly and a data conduit adapted to transmit data between the surface and the downhole assembly, wherein the power conduit comprises a single electrical conductor adapted to form part of an electrical circuit between the downhole assembly and a power supply, and wherein the method includes moving the downhole assembly by the locomotive, powering the locomotive through the single electrical conductor, and completing the electrical circuit between the locomotive and the power supply at the surface through an earth connection between the downhole assembly and the well.

The present invention provides a method of logging an oil or gas well, comprising moving a downhole assembly into the well, said downhole assembly comprising a logging sensor adapted to collect data from the well, the downhole assembly having a downhole locomotive, a power conduit adapted to supply power to the downhole assembly from the surface, and a data conduit adapted to transmit data between the surface and the downhole assembly, wherein the power conduit comprises a single electrical conductor adapted to form part of an electrical circuit between the downhole assembly and a power supply at the surface, and wherein the method includes moving the downhole assembly by the locomotive, powering the locomotive through the single electrical conductor, and completing the electrical circuit between the locomotive and the power supply at the surface through an earth connection between the downhole assembly and the well.

Optionally the strength member is formed around the outer surface of the power or data conduit, optionally by combining continuous strands of fibre, optionally around a continuous length of power and data conduit. Optionally the strands of fibre are formed around the power or data conduit while the strands are under tension, optionally in a pultrusion process, which optionally combines curable resin (for example epoxy resin, optionally pourable) into the strength member in liquid form as the strands are being formed into the strength member, and in which the resin is allowed or caused to set from a liquid phase to a more solid or gelled phase during formation of the strength member. Optionally more than 90% of the fibres in the strength member are aligned with the long axis of the strength member, optionally more than 95%, e.g. 95-98%. 90% of the fibres in the strength member are continuous along the long axis of the strength member, optionally more than 95%, e.g. 95-98%. Optionally the strength member is covered by a braided or woven layer on its outer surface formed from braided or woven or otherwise interconnected strands of fibre, which are also combined with resin which sets to form the outer layer. Optionally the strength member is formed by a fibre-reinforced (optionally carbon fibre) polymer layer, which optionally covers a layer of insulation material. Optionally the strength member provides mechanical strength to the cable, and also optionally acts as a barrier to well fluids.

Optionally the cable can be formed and deployed in the same manner as disclosed in U.S. Pat. No. 7,769,260, the disclosure of which is incorporated herein by reference, and the cable can comprise a stiff rod with a limited minimum bend radius or a more flexible cable, depending on the number and arrangement of fibres used in the strength member.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still other aspects, features, and advantages of the present invention are readily apparent from the entire description thereof, including the figures, which illustrates a number of exemplary aspects and implementations. The invention is also capable of other and different examples and aspects, and its several details can be modified in various respects, all without departing from the scope of the present invention. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. In particular, unless otherwise stated, dimensions and numerical values included herein are presented as examples illustrating one possible aspect of the claimed subject matter, without limiting the disclosure to the particular dimensions or values recited. All numerical values in this disclosure are understood as being modified by "about", which unless otherwise stated is understood to mean+−5% of the value concerned. All singular forms of elements, or any other components described herein are understood to include plural forms thereof and vice versa.

Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprise" or variations thereof such as "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all of these matters formed part of the prior art base or were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

References to directional and positional descriptions such as upper and lower and directions e.g. "up", "down" etc. are to be interpreted by a skilled reader in the context of the examples described to refer to the orientation of features shown in the drawings, and are not to be interpreted as limiting the invention to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

DETAILED DESCRIPTION OF THE INVENTION

Figure 1:
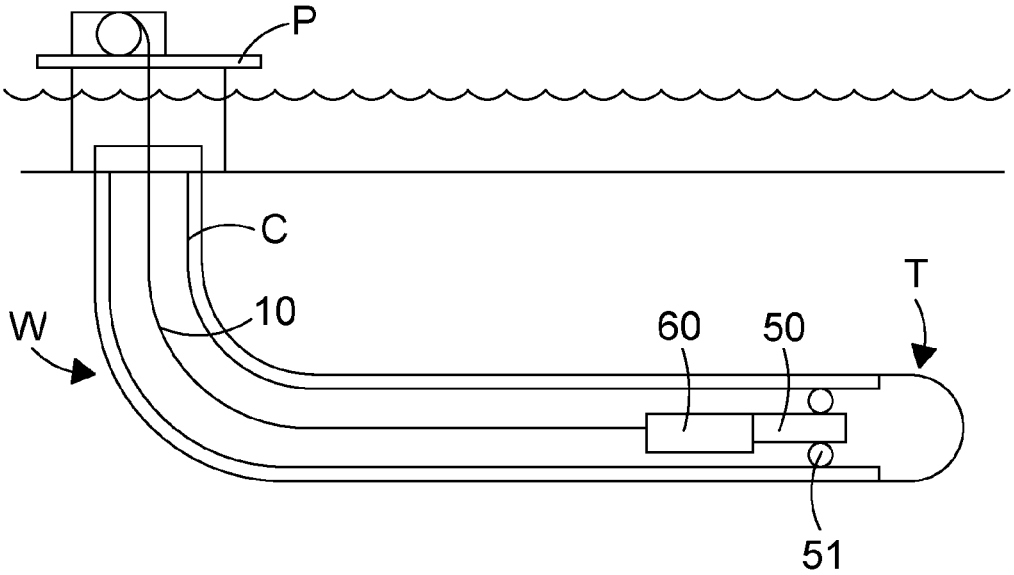
FIG. 1 shows a schematic view of a well in which a logging assembly is deployed.

Referring now to the drawings, a well W (here shown as an offshore well but the assembly can equally be used with land wells) has a wellbore with a toe T, and is producing useful production fluids from a formation surrounding the toe. The well W is a deviated well (although the assembly is equally appropriate for use in vertical wells) and the toe T is several kilometres (e.g. 5-10 km) from the wellhead. Production fluids are produced to a platform P above the wellhead. The wellbore is cased by metal casing C. As the production fluids are flowing through the well W, they are logged by a logging assembly comprising a cable 10, a locomotive in the form of a tractor 50, and optionally in this case a downhole sensor 60, which is adapted to detect one or more downhole conditions in the produced fluids, such as temperature, pH, pressure, salinity, resistance, etc. The downhole sensor 60 can be a collection of sensors adapted to detect different parameters in the well, and can either be collected together in a single sub as shown in FIG. 1, or other components of the assembly can be adapted to collect the data, for example, in some cases, the cable 10 can be adapted to collect data from the well W. The downhole sensor 60 can be connected to the data conduit within the cable 10, for transmission of data to or from the surface.

Figure 2:
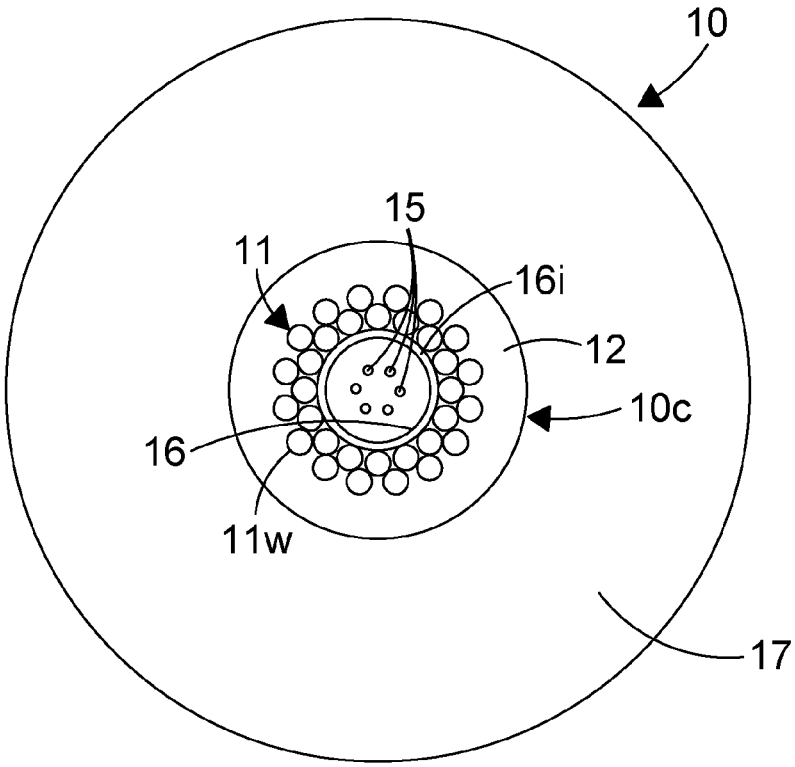
FIG. 2 shows a cross-sectional view through a cable used in the logging assembly of FIG. 1.

In this example, the cable 10 comprises a number of layers which are concentric as shown in FIG. 2. The innermost layer comprises a data conduit, here taking the form of one or more fibre optic lines 15, which extend the length of the cable 10 from the platform P to the toe T and which in this example are mutually parallel. Optionally the fibre optic cables 15 are suspended in a gel, for example a thixotropic gel, and are optionally housed in a metal (e.g. stainless steel 316L) tube 16, which also extends the length of the cable 10 from the platform P to the toe T. Optionally the metal tube 16 has a layer of insulation 16*i* on its outer surface to electrically insulate the metal tube 16 from the next layer, which in this example comprises a power conduit in the form of a braided layer of copper wires 11*w* forming a single electrical conductor 11 or single phase effectively conducting current as a single wire. Outside the single phase braided layer of electrical conductor 11 there is a layer of electrical insulation 12, and outside the layer of electrical insulation 12 there is a strength member 17, which resists axial extension of the cable 10.

In this example, the inner layers of the fibre optic lines 15 and tube 16 and the power conduit comprising the electrical conductor 11 (optionally with various layers of insulation e.g. 16*i*, 12 etc. together form the cable core 10*c*, which is then covered by the strength member 17.

The optical fibres 15 are suitable for use in oil and gas wells with a temperature rating of at least 250 degrees Celsius, and are encased in a 316L stainless steel tube 16 by forming a flat steel strip of constant depth into a tube around the fibre strands. A thixotropic protective gel is optionally injected at this point around the fibres and then the gap in the tube laser welded to form a solid seam making the tube 16 pressure tight. The resulting tube 16 (in the art called a "FIMT": Fibre In Metal Tube) is coiled on a reel for further processing. Next, a layer of braided copper wire 11*w* is formed onto the outer surface of the tube 16 in a continuous process to form a conductive layer 11 that will form the electrical conductor. If insulation is required the tube (optionally with its externally braided copper layer 11) is then run on a cable insulation extruder line which places molten fluoropolymer in a layer to cover the inner layer and provide the requisite insulation material thickness to meet a required working voltage of 1200 Volts at 177 degrees Celsius. The breakdown voltage is optionally higher than this, and a typical safe margin might be up to 1500V. The layer of insulation is cooled in a water bath and then dried before being tested in a spark tester to verify there are no pin holes or voids in the insulation material. During formation of the tube 16, the welding process is optionally controlled when sealing the seam of the metal tube 16 around the fibre optic lines 15. A laser welding head is typically held constant relative to the seam to be welded while the production line is moving at a constant rate.

Data is transmitted through the fibre optic lines 15 from the surface downhole to actuate or control downhole tools, in this example the tractor 50. The fibre optic lines 15 can transmit data to and/or optionally from the tractor 50 to control the tractor 50, and to transmit data relating to the tractor 50 back to the surface. Preferably 2-10 fibre optic lines are provided; in this example 6 fibre optic lines 15 are shown.

The electrical conductor 11 transmits current (DC in this example) from a power supply at the surface, to the downhole portion of the assembly, without carrying the return path of the current from the downhole portion to the surface. The power conduit can supply power to one or both of the downhole sensor 60 and the tractor 50.

In the example shown in FIG. 2, the electrical conductor 11 has a tubular structure, concentric with the long axis of the cable 10. The conductor 11 surrounds the outer surface of the insulating layer 16*i* around the metal tube 16 housing the fibre optic lines 15.

Each layer of insulation can comprise typical polymeric plastics materials such as PE, PVC, PTFE, and/or PEEK, preferably a fluoropolymer. The electrically insulating layer 12 is of a predetermined thickness that can meet requirements for the expected working voltage and temperature. By way of example, the insulating layer 12 may be of a thickness suitable to meet a required working voltage of up to 1200 Volts at 177 degrees Celsius.

The strength member 17 resists axial strain on the power and data conduits, and is resistant to axial extension under loading along the long axis of the cable 10. The strength member 17 in this example comprises a composite layer of carbon fibre and curable resin. The carbon fibres in this example are substantially unidirectional and are optionally parallel to the long axis of the cable, and the strength member can be substantially as described in U.S. Pat. No. 7,769,260, the disclosure of which is incorporated herein by reference. The outer surface of the cable 10 can be formed by the composite layer of the strength member 17, which has a relatively low coefficient of friction. The low coefficient of friction advantageously reduces running loads when the cable is being run in and out of the well, enabling increased pulling force to be available to the downhole end of the cable in comparison to a standard wireline.

The strength member 17 is applied over the outer surface of the power conduit. The strength member 17 is electrically non-conductive, or is of low conductivity, so that it can act as an electrical insulator for the power conduit in addition to the adjacent insulating layer 12.

The strength member in this example is a carbon composite outer layer, formed by weaving or otherwise forming together the electro optical insulated core with numerous unidirectional strands of carbon fibre impregnated with epoxy resin into a die where the composite is formed into a cylinder around the core, optionally at pressure and temperature and the epoxy begins to cure. Various methods of curing the composite material can be used. After the die the production line optionally has a curing oven section to achieve optimum polymer cross-linking of the resin. The cable 10 is pulled through these stations by hydraulic grippers that maintain a constant speed of progress. The cable 10 is optionally a continuous length that is coiled onto a spool at the end of the production line.

The strength member 17 also provides mechanical support for any tools that are attached to the downhole end of the cable 10, such as the tractor 50. The mechanical support offered by the strength member 17, coupled with its low friction coefficient, enhances the extraction of tools and the cable 10 out of a difficult well, e.g. where there are blockages or other obstructions in the bore.

Figure 3:
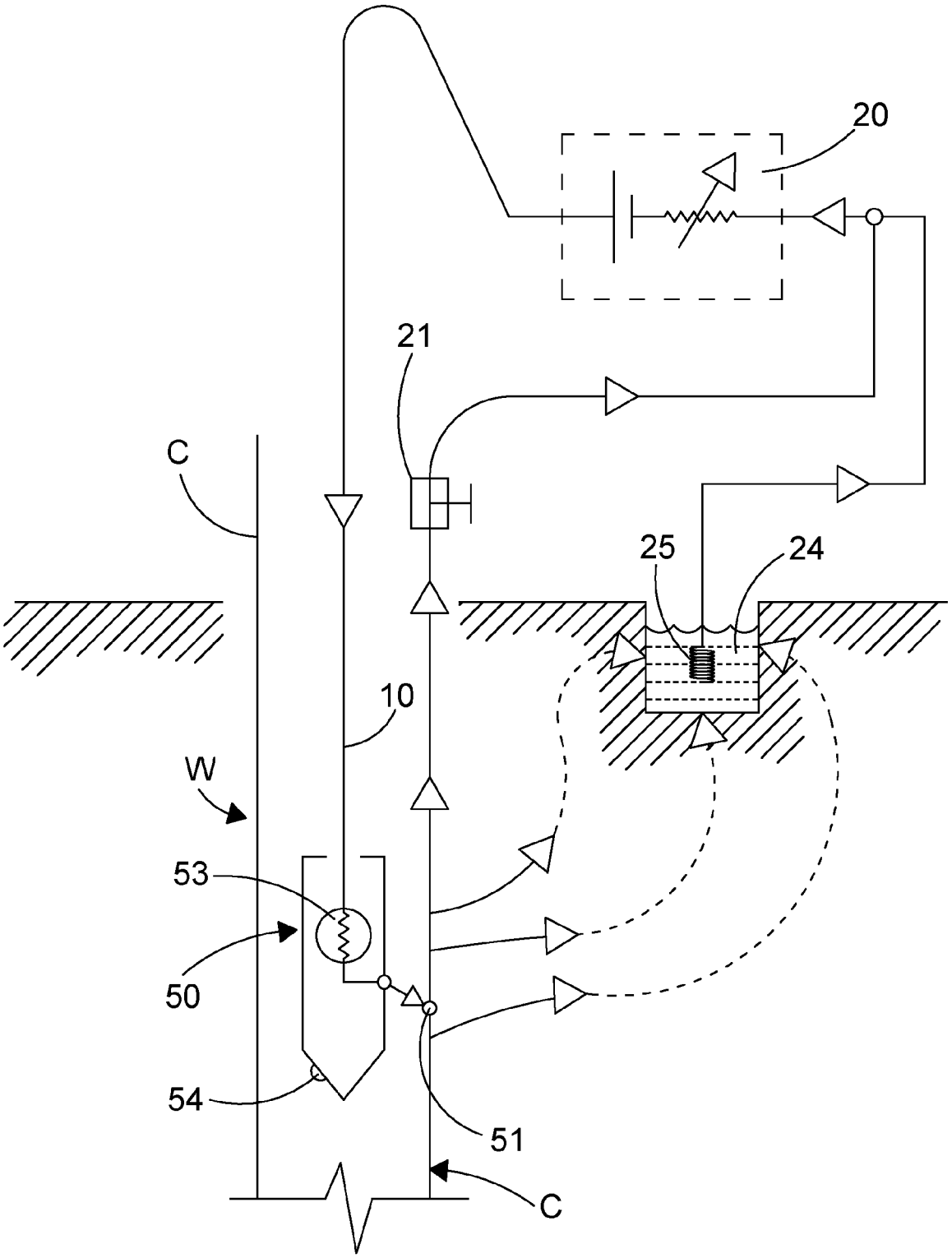
FIG. 3 shows a schematic view of the assembly in the FIG. 1 well.

The path of the electrical signal is shown in FIG. 3. Tractor 50 is shown deployed within the well W, and comprises a motor 53 within a chassis 54. Attached to the chassis is a wheel 51 or similar conveyance mechanism which contacts the inner diameter of the casing C (best seen in FIG. 5), and is also electrically connected to the motor 53, such that the wheel 51 takes the form of an electrical contact exposed to the well, and engaged with the inner surface of the casing C. Power is supplied to the motor 53 from the surface power supply 20, which transfers power through the conductor 11 in the cable 10 downhole.

The current then passes from the motor 53 through the casing C via an electrical contact which in this case takes the form of the wheel 51, which is exposed to the well and is able to make an electrical connection with the well, for example, with the casing C, to provide a part of the return path for the electrical circuit between the motor 53 and the power supply 20. The return path for the current from the motor 53 back to the power supply 20 passes through the earth, in some situations through porous formation layers that may be liquid-filled, enhancing conductivity of the layers. At surface, there is a pit 24 filled with a conductive fluid such as brine, which has an electrode 25 submerged within it. The electrode 25 connects to the power supply 20 and completes the circuit. The power supply 20 may be electrically connected to the well W via a clamp 21 attached to the casing C. As shown in FIG. 3, this may provide a further return path for the electrical signal to travel towards the surface through the casing C, into the clamp 21, and from there into the power supply 20 via a cable or similar conductive line.

Figure 4:
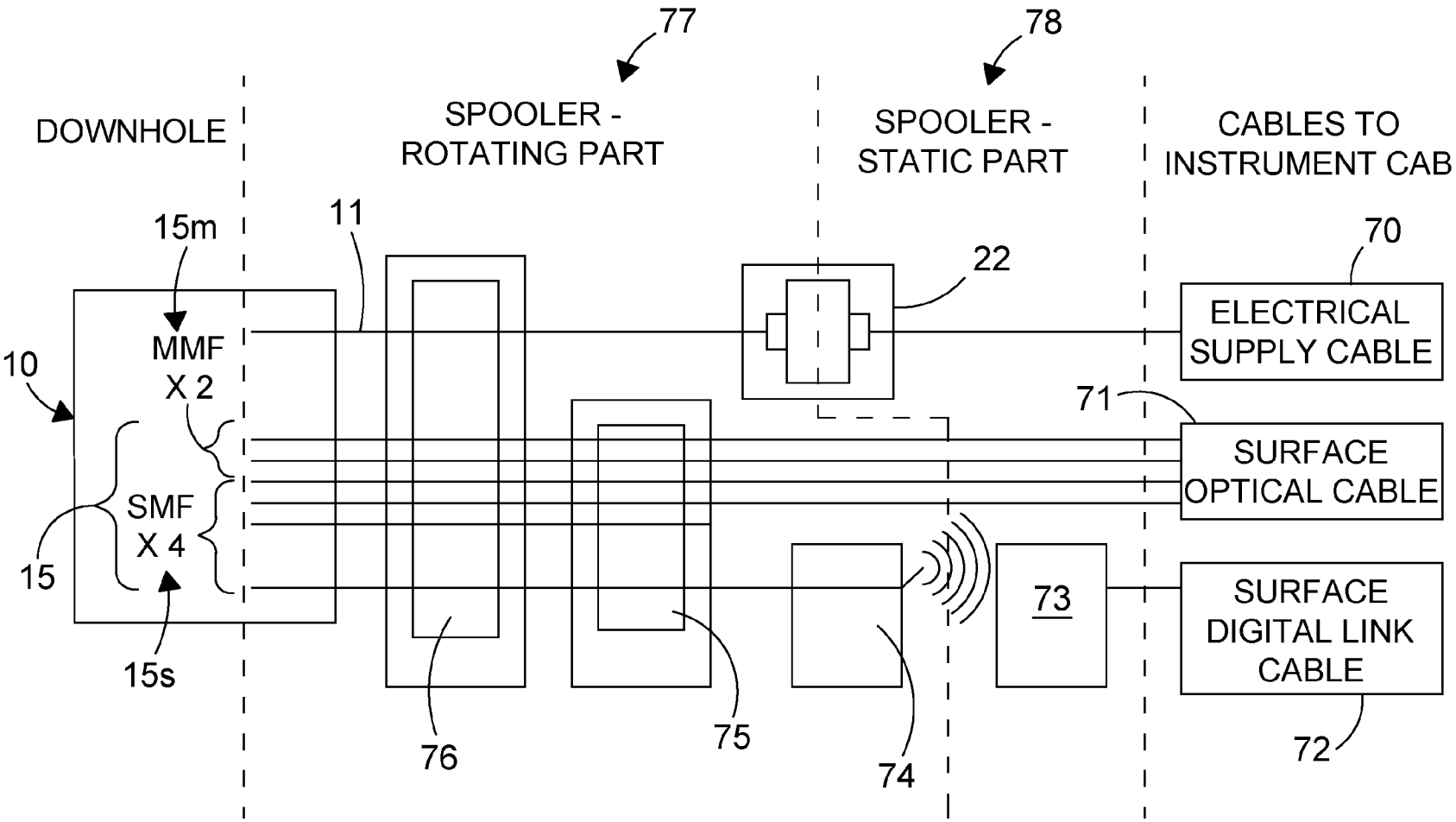
FIG. 4 shows a schematic view of electrical connections in the assembly.

FIG. 4 shows a detailed schematic view of the electrical connections between the surface and cable. At the surface there are at least three cables supplying the instrument cab: an electrical supply cable 70, optical cable 71, and digital link cable 72.

The surface electrical supply cable 70 connects to the power supply 20, via an electrical high voltage slip-ring collector 22, housed within an ATEX compatible enclosure. The slip-ring collector 22 establishes the electrical path between the static part of spooler 78 and the rotating (drum) part of spooler 77, which are configured to control the pay out and reeling in of the cable 10 while maintaining electrical and data connections during the spooling. The cable 10 passes into the hollow hub space of a drum on the rotating spooler 77 and through an ATEX-compatible pressure containing enclosure 76, within the rotating spooler 77. In this example, the pressure rating of the enclosure 76 is 10 kpsi (approx. 69 MPa), but can be any suitable value within the range 5 to 15 kpsi (approx. 34-103 MPa), optionally in line with the pressure rating of the surface well pressure control equipment appropriate for the well in question.

The fibre optic lines 15 within cable 10 can optionally comprise a combination of multimode fibre optic lines (MMF) 15*m* and single-mode fibre optic lines (SMF) 15*s*. In the example shown in FIG. 4, there are 2 MMF lines 15*m* and 4 SMF lines 15*s*. The two MMF lines 15*m*, and two SMF lines 15*s*, extend from downhole, through the pressure containing enclosure 76, and connect to the surface optical cable 71 which runs to the instrument cab.

One of the remaining SMF lines 15*s* terminates within a rotating optical junction box 75 which is within the rotating spooler drum 77, and is located on an uphole side of the cable relative to the pressure containing enclosure 76. The last SMF line 15*s* extends through the optical junction box 75, and terminates within a rotating optical telemetry and digital link assembly 74. The digital link assembly 74 transmits data wirelessly to a wireless transmitter/receiver device 73 mounted on the static frame part 78 of the spooler. The wireless device 73 then transmits the data received from the digital link assembly 74 to the instrument cab via a surface digital link cable 72.

Figure 5:
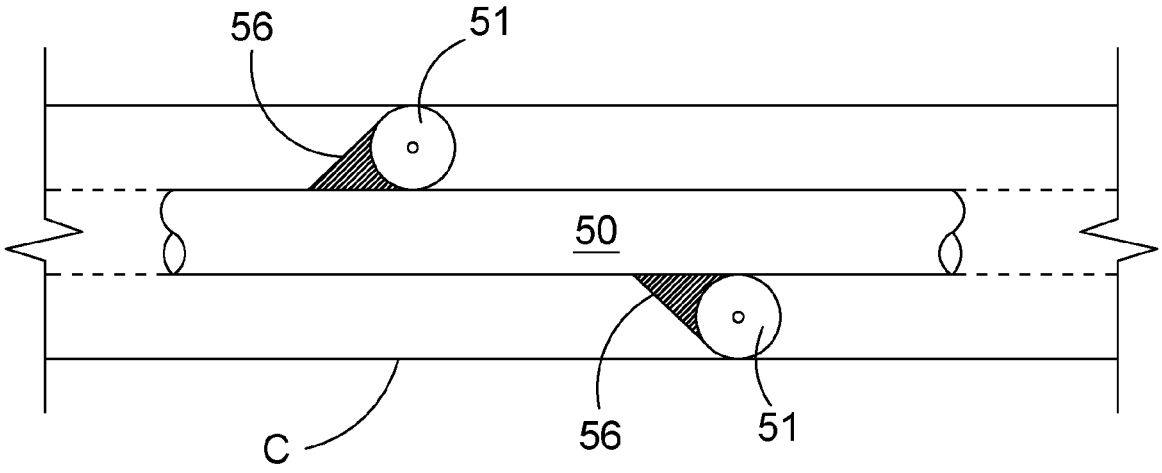
FIG. 5 shows a side view of a locomotive used in the FIG. 1 assembly.
Figure 6:
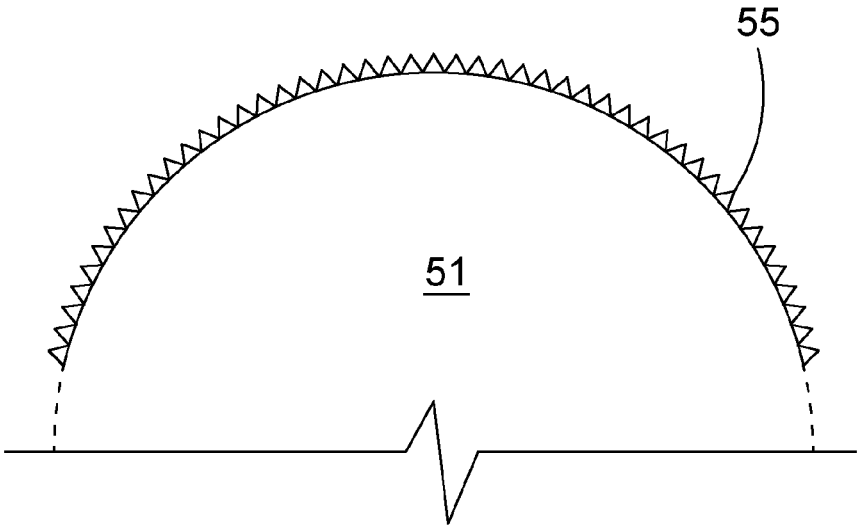
FIG. 6 shows a side view of a conveyance mechanism used in the FIG. 1 assembly.

FIGS. 5 and 6 show close-up views of the tractor 50 and the wheel(s) 51. The tractor wheels 51 comprise a toothed or ridged outer surface 55 which enhances the grip of the wheel 51 against the casing C as the tractor 50 moves downhole. The ridges also enhance the electrical contact between the tractor 50 and the casing C. The wheels 51 are affixed on the end of arms 56, and the arms 56 (and wheels 51) are optionally retracted into the body of the tractor 50 as the tractor 50 is lowered downhole, or as the tractor 50 is pulled out of the well, to ease movement of the tractor 50 within the bore. FIG. 5 shows the arms 56 in an extended position with the wheels 51 in engaging the inner surface of the casing C. The wheels 51 are adapted to drive the tractor 50 axially within the well by providing grip for the tractor 50 as it ambulates in the well. Wheels 51 can be mounted at regular (e.g. 180°,90°) circumferential spacing in order to centralise the tractor 50 in the well W. Optionally wheels can be mounted in pairs at 180° spacing, and multiple pairs can be provided which are circumferentially offset from one another by 90°, and optionally axially offset.

Figure 7:
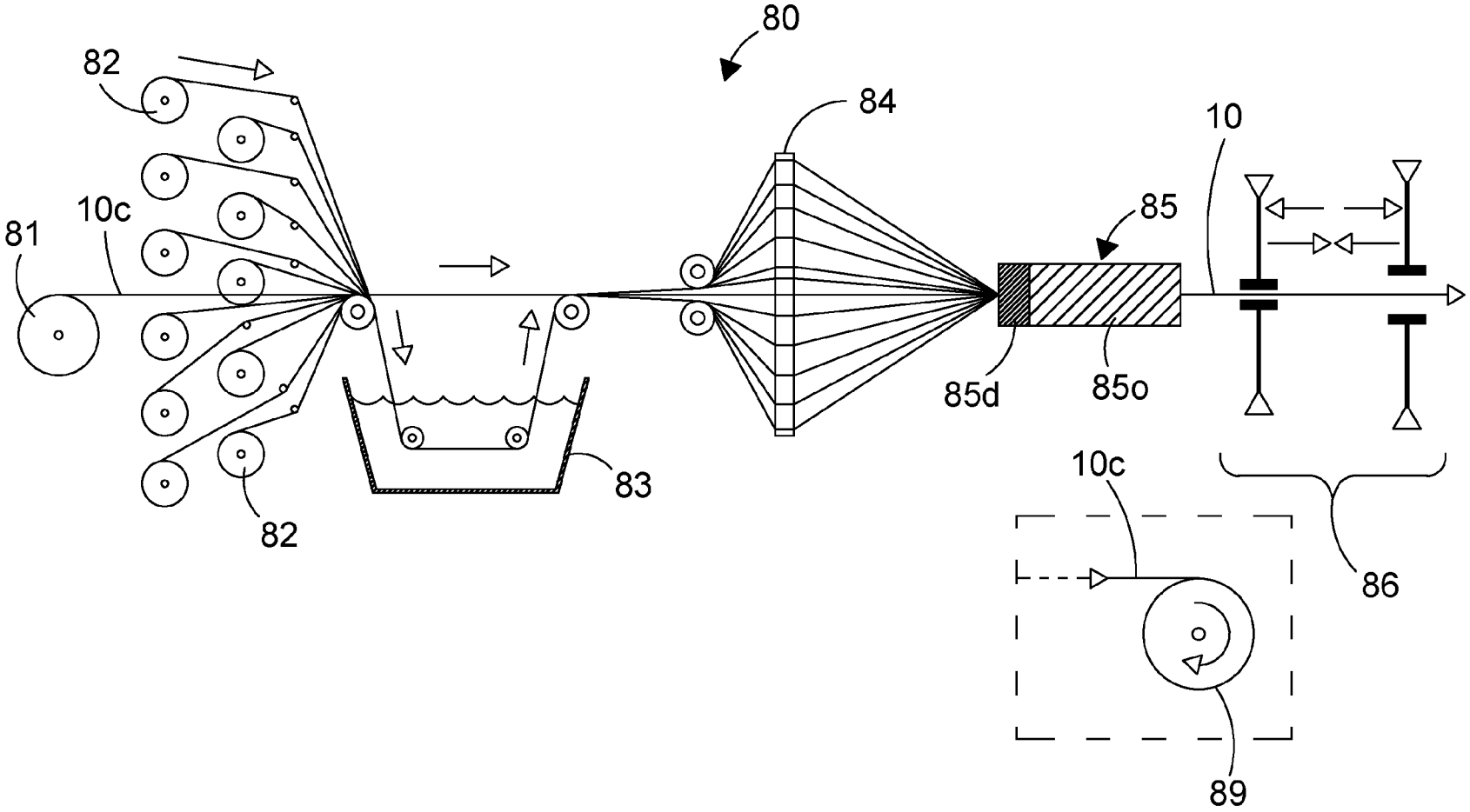
FIG. 7 shows a schematic loom for the construction of the cable used in the FIG. 1 assembly, where the strength member is formed as a rod.

FIG. 7 shows a schematic example of a pultrusion process suitable for application of the strength member 17 onto the cable. The unfinished cable core 10*c* comprising the array of fibre optic strands 15 in the metal tube 16 (so called Fibre In Metal Tube or "FIMT") which is optionally covered with a layer of insulation 16*i* and a braided layer 11 comprising a power conduit is stored on a reel 81, from which it is paid out through the pultrusion assembly 80. The carbon fibre is fed into the line from a rack assembly or creel board holding carbon fibre bobbins 82, which pay out carbon fibre under tension. In some examples, the rack assembly may comprise e.g. 180-220 carbon fibre bobbins 82. The carbon fibre strands are dipped in a resin bath 83 to combine the carbon fibre with curable resin such as epoxy resin. The resin is in liquid form in the bath 83 and coats the carbon fibre as it passes through the bath 83.

Once coated with resin, the carbon fibre strands are then passed through a guide plate 84, which defines the relative positions of the carbon fibres and the core 10*c*. The core 10*c* is passed through a central aperture in the guide plate 84, and the carbon fibres pass through apertures that are in a generally circular arrangement around the central aperture. Optionally more than 90% of the fibres in the strength member 17 are aligned with the long axis of the strength member 17, optionally more than 95%, e.g. 95-98%. 90% of the fibres in the strength member 17 are continuous along the long axis of the strength member 17, optionally more than 95%, e.g. 95-98%. The guide plate 84 enhances this alignment, and as the fibres are under tension, they substantially resist torsion and misalignment during make-up of the cable 10.

Once the fibres have passed through the guide plate 84, they are brought radially inwards towards the outer surface of the cable core 10*c*. The fibres and cable core 10*c* then enter one end of a heated die 85*d* contained within the heat-treatment housing 85, which heats and contains under pressure the cable core 10*c* and fibres, and cures the resin coating the fibres around the core 10*c*. This sets the outer layer of the cable 10, and forms the strength member 17. The formed rod then continues to move through a heated curing oven section 85*o* within the heat-treatment housing 85.

In order to extract the cable 10 from the other end of the heat-treatment housing 85, haul-off pistons 86 are used to sequentially actuate and pull the cable 10 from the housing 85. The cable 10 is then applied to a spool 89 and coiled around said spool 89 ready for use.

Optionally, the line runs continuously, and optionally at a steady speed during pultrusion as the epoxy curing reaction begins once the components enter the die and the viscosity of the mix rapidly increases. The epoxy resin bath or vat wetting the carbon fibres is optionally reloaded or refreshed regularly as it is consumed. The paths of all carbon fibre strands feeding the pultrusion line are optionally monitored to identify and remove any catching of loose fibre filaments on a guide plate hole. Optionally the production line has a continuous uninterrupted power supply, optionally directly from an independent electrical generator for the entire duration of the production run. As an additional optional safeguard to mitigate the risk of a failure of the pultrusion line machinery, a second back-up set of haul-off pistons may be installed immediately after the primary pistons 86, ready to take over should a failure (electrical or hydraulic) occur.

Figure 8:
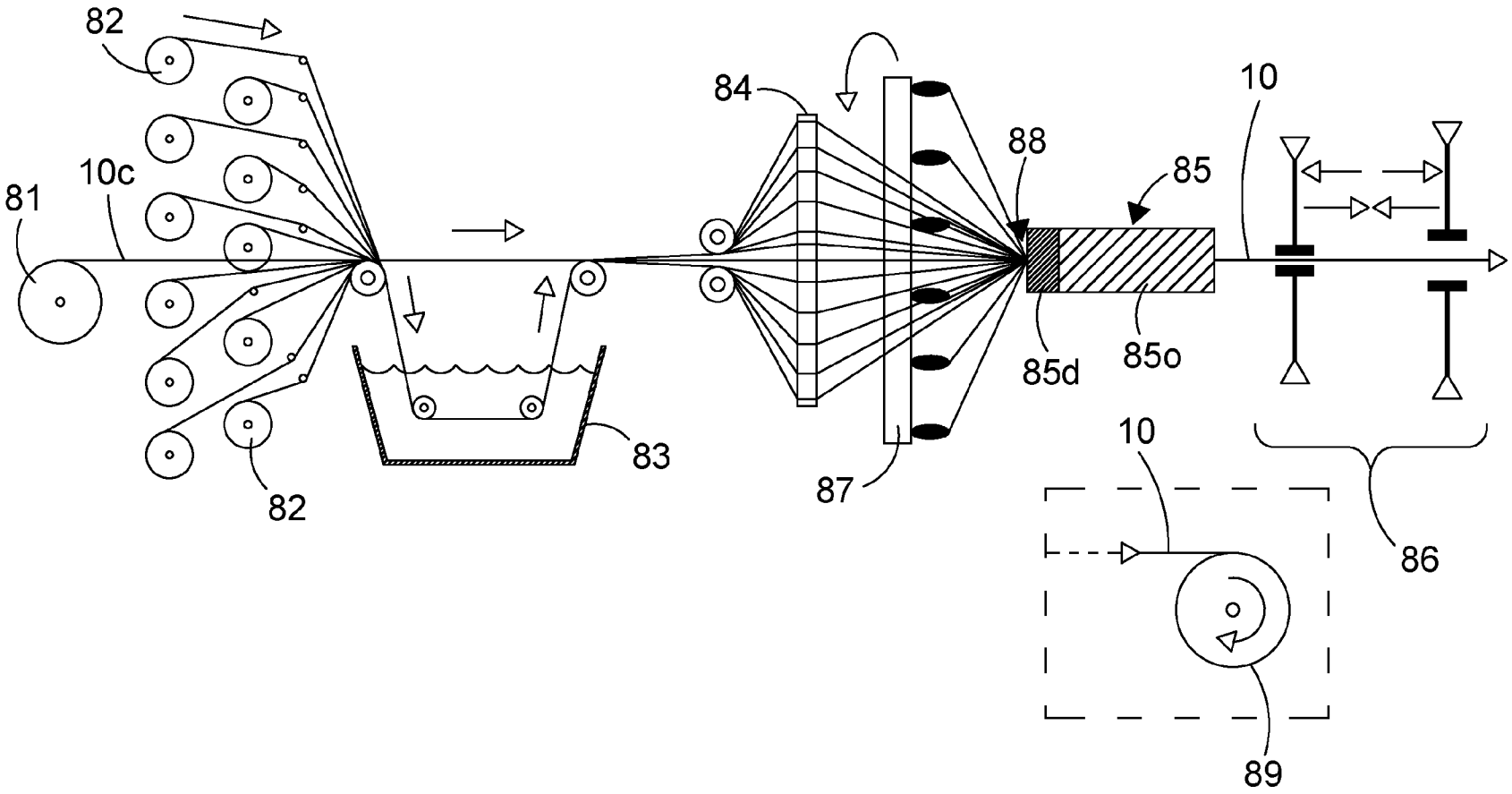
FIG. 8 shows a schematic loom for the construction of the cable used in the FIG. 1 assembly, where the strength member has a further fibre-based layer braided onto its outer surface.

In another example of the formation of the strength member 17, shown in FIG. 8, the pultrusion process is substantially as detailed above with carbon fibre lines being laid on the outer surface of the unfinished cable core 10*c* to form the strength member 17. Prior to entering the heat-treatment housing 85, however, as the carbon fibre lines are being brought towards the surface of the cable, there is an additional braiding machine 87 that rotates around the cable/carbon fibre lines combination. The strength member 17 is covered by a braided carbon fibre layer on its outer surface, formed from braided or otherwise interconnected strands of carbon fibre, which are also combined with resin which sets to form the outer layer. The braiding fibres are wetted by a stream of resin 88 that is fed continuously onto the braid prior to the cable and fibres being fed into the heated die 85*d*.

An example of a suitable resin that may be used in accordance with the invention is Starting Formulation No. 8018, available from Resolution Performance Products LLC, USA. A suitable carbon fibre that may be used in accordance with the invention is H2055 C10 produced by Hyosung, Seoul, Korea. Other types of resin, curing agents and fibre can be used in other examples of the invention.

Optionally the strength member is formed by a fibre-reinforced (optionally carbon fibre) polymer layer, which optionally covers a, or the, layer of insulation material.

Optionally the cable can be formed and deployed in the same manner as disclosed in U.S. Pat. No. 7,769,260, the disclosure of which is incorporated herein by reference, and the cable can comprise a stiff rod with a limited minimum bend radius or a more flexible cable, depending on the number and arrangement of fibres used in the strength member.

One example of operation of the assembly will now be described, using the cable 10 which has been formed as outlined above and is spooled onto a transport reel 89. The ends of the cable 10 are terminated with appropriate end terminations (optically and electrically). A bottom hole termination is then made up on a downhole portion of the cable 10 by connecting fibre optic cables to quick connect optics plug to mate with corresponding mating item within an Bottom Hole Assembly (BHA) housing optionally forming part of the downhole portion of the assembly. The copper wires 11 are typically left exposed and an electrical connection is optionally prepared by soldering pig-tail leads to these. The pin at other end of pig-tail is optionally plugged into the relevant electrical connection in the connection chamber of the BHA. Any exposed metal surfaces at end of stainless steel tube are then optionally insulated e.g. with a PEEK boot to prevent contact with BHA housing or chassis parts. A surface termination is then optionally made e.g. in the hollow core of the rotating spooler drum 77, and the inner end of the cable is optionally pulled into a pressure containing termination box 76 through a pressure gland. Inside this box the composite and fluoropolymer insulation layers are typically removed, and electrical connections are optionally made by gathering copper cable strands 11*w* from the electrical conductor 11 and crimping to a connector on the pig-tail from a pressure tight electrical feed-through mounted in the wall of the termination box. The optical fibres from the central stainless steel tube are optionally spliced to a multi-pin optical feedthrough pig tail, leading to the external optical connector on the termination box. The electrical outlet from the pressure containing termination box is optionally connected to the high voltage electrical slip ring collector 22 mounted on the hub of the spooler 77/78. The static electrical lead 70 from the collector is then optionally connected to the motor power supply panel in the instrument cabin. The optical fibres are optionally routed from the pressure containing termination box 76 to the optical junction box 75 and optionally split internally to one single mode connector socket and one multi line connector for 2 multi-mode and 2 single mode fibres. Optionally, a single mode line is connected to the optical telemetry and wireless link enclosure 74 also optionally mounted in the hollow core of spooler drum 77. The wireless link carries digital information across to the non-rotating wireless enclosure 73 and from there via cable 72 to the instrument cabin. The multiple line optic fibres 15 are optionally connected to the instrument cabin via cable 71 to the distributed measurement interrogator panels when the drum is stationary. The return line on the tractor 50 is optionally routed through the 21 clamp firmly connected to the head of the well structure (e.g. a wellhead body or any casing or tubing string exposed at surface) and (if also employed) an electrode 25 immersed in an open ground pit or hole 24 filled with conductive drilling mud or brine. The tractor 50 is then connected into the downhole portion optionally as a toolstring below the BHA, which is then run into the well under its own weight until the downhole portion reaches maximum depth and can penetrate no further without powered assistance form the tractor 50. At this point the tractor 50 is powered up to pull the downhole portion containing the BHA deeper into the well, with the return path of the DC power being routed through the electrical contact on the tractor wheel 51, casing C, clamp 21, pit 24, and electrode 25, rather than passing through the cable 10 in the return path. Thus the electrical circuit only passes through the cable in one leg of the circuit and is returned through the earth connection between the electrical contact made by the wheel 51 on the casing C etc. The tractor 50 is run until maximum expected depth is reached or the tractor 50 reaches an obstruction it cannot overcome. At this stage, the tractor 50 can be powered down and the cable 10 can be pulled up slightly until free steady weight is observed and the cable 10 is pulled straight. The fibre optic interrogators are then connected to the fibre optic junction box in the hub of the reel 89, and distributed fibre optic data acquisition can then begin by collecting data along the length of the cable 10 by known means, or alternatively data can be collected through the logging tool 60 and transmitted through the data conduit of the optical fibres 15 back to the surface. Once all data required is obtained through shutting in and flowing the well under different settings, fixed leads to the fibre optic junction box can be disconnected and the cable 10 and downhole portion comprising the BHA can be pulled out of the hole. Optionally during this pulling out of the hole sequence logging data can be recorded from point sensors located on logging tool 60 over any depth interval of potential interest.

Modifications and improvements may be made to the examples and embodiments hereinbefore described without departing from the scope of the invention.

What is claimed is:

1. A well logging assembly adapted to collect data from a well, comprising a downhole locomotive adapted to move a downhole portion of the well logging assembly into the well, the assembly comprising a power conduit adapted to supply power from the surface to the downhole portion and a data conduit adapted to transmit data from the downhole portion to the surface, wherein the power conduit comprises a single electrical conductor adapted to send electric current to the downhole portion from a power supply at the surface, and wherein the downhole portion comprises an electrical contact exposed to the well adapted for transmission of electric current on a return path to the surface, wherein the locomotive incorporates at least one electrical contact to earth the locomotive and to complete an electrical circuit between the power conduit, the well and the power supply at the surface.

2. An assembly according to claim 1, wherein the electrical contact is adapted to engage an inner surface of the well.

3. An assembly according to claim 1, wherein the well is cased with electrically conductive casing, and the return path for the electric current from the downhole portion to the surface passes through the casing.

4. An assembly according to claim 1, wherein the power supply is electrically connected to the well by a clamp connecting the power supply to an electrically conductive portion of the well at the surface.

5. An assembly according to claim 1, wherein the return path for the electric current passes through the earth.

6. An assembly according to claim 1, wherein the return path for the electric current passes through a conductive fluid collected in a pit at the surface, and connected to the power supply to complete the circuit via an electrode connecting the conductive fluid in the pit to the power supply.

7. An assembly according to claim 1, wherein the return path for the electric current passes through fluids produced from the well.

8. An assembly according to claim 1, wherein the data conduit is adapted to transmit data from the surface to the downhole portion.

9. An assembly according to claim 1, wherein the downhole portion incorporates a sensor connected to the downhole end of one or more of the power conduit and the data conduit, wherein the sensor is adapted to sense downhole conditions and to transmit data concerning downhole conditions to the surface.

10. An assembly according to claim 1, wherein the power conduit comprises a plurality of individual wires formed into a single phase electrical conductor, adapted to transmit the electric current from the power supply at the surface to the downhole portion in the well without carrying the electric current on a return path from the downhole portion to the surface.

11. An assembly according to claim 1, wherein the power conduit consists of a single phase electrical conductor.

12. An assembly according to claim 1, wherein the logging assembly comprises a strength member adapted to resist axial extension of the downhole portion.

13. An assembly according to claim 12, wherein the strength member comprises a composite material.

14. An assembly as claimed in claim 12, wherein the strength member electrically insulates the outer surface of the power conduit from the well environment.

15. An assembly according to claim 12, wherein the strength member comprises a plurality of continuous strands of fibre combined with curable resin.

16. An assembly according to claim 1, wherein the power conduit and data conduit are combined in a cable or rod.

17. An assembly according to claim 1, wherein the return path for the electric current to the surface passes through the locomotive.

18. An assembly according to claim 1, wherein the locomotive incorporates at least one conveyance mechanism which engages the inner surface of the well, and wherein the conveyance mechanism is driven to move the locomotive axially within the well, and wherein the return path for the electric current passing from the downhole portion to the surface passes through the conveyance mechanism.

19. An assembly according to claim 1, wherein the electrical contact is resiliently biased radially outward from a body of the downhole portion, into contact with an inner surface of the well.

20. A method of logging an oil or gas well, comprising moving a downhole assembly into the well, said downhole assembly comprising a logging sensor adapted to collect data from the well, the downhole assembly having a downhole locomotive, a power conduit adapted to supply power to the downhole assembly from the surface and a data conduit adapted to transmit data between the surface and the downhole assembly, wherein the power conduit comprises a single electrical conductor adapted to form part of an electrical circuit between the downhole assembly and a power supply at the surface, and wherein the method includes moving the downhole assembly by the locomotive, powering the locomotive through the single electrical conductor, and completing the electrical circuit between the locomotive and the power supply at the surface through an earth connection between the downhole assembly and the well, the earth connection comprising at least one electrical contact on the locomotive.

21. A data transfer assembly adapted to transmit data to or from an oil or gas well, comprising a downhole locomotive adapted to move a downhole portion of the data transfer assembly into the well, the assembly comprising a power conduit adapted to supply power from the surface to the downhole portion and a data conduit adapted to transmit data between the downhole portion and the surface, wherein the power conduit comprises a single electrical conductor adapted to send electrical current to the downhole portion from a power supply at the surface, and wherein the downhole portion comprises an electrical contact on the locomotive exposed to the well adapted for transmission of the electric current on a return path to the surface.

22. A method of transferring data to or from an oil or gas well, comprising moving a downhole assembly into the well, the downhole assembly having a downhole locomotive, a power conduit adapted to supply power to the downhole assembly and a data conduit adapted to transmit data between the surface and the downhole assembly, wherein the power conduit comprises a single electrical conductor adapted to form part of an electrical circuit between the downhole assembly and a power supply, and wherein the method includes moving the downhole assembly by the locomotive, powering the locomotive through the single electrical conductor, and completing the electrical circuit between the locomotive and the power supply at the surface through an earth connection between the downhole assembly and the well, the earth connection comprising at least one electrical contact on the locomotive.

23. A well logging assembly adapted to collect data from a well, comprising a downhole locomotive adapted to move a downhole portion of the well logging assembly into the well, the assembly comprising a power conduit adapted to supply power from the surface to the downhole portion and a data conduit adapted to transmit data from the downhole portion to the surface, wherein the power conduit comprises a single electrical conductor adapted to send electric current to the downhole portion from a power supply at the surface, and wherein the downhole portion comprises an electrical contact exposed to the well adapted for transmission of electric current on a return path to the surface, wherein the return path for the electric current passes through a conductive fluid collected in a pit at the surface, and connected to the power supply to complete the circuit via an electrode connecting the conductive fluid in the pit to the power supply.

24. A well logging assembly adapted to collect data from a well, comprising a downhole locomotive adapted to move a downhole portion of the well logging assembly into the well, the assembly comprising a power conduit adapted to supply power from the surface to the downhole portion and a data conduit adapted to transmit data from the downhole portion to the surface, wherein the power conduit comprises a single electrical conductor adapted to send electric current to the downhole portion from a power supply at the surface, and wherein the downhole portion comprises an electrical contact exposed to the well adapted for transmission of electric current on a return path to the surface, wherein the return path for the electric current passes through fluids produced from the well.

* * * * *